US009228353B2

(12) United States Patent
Alammari

(10) Patent No.: US 9,228,353 B2
(45) Date of Patent: Jan. 5, 2016

(54) ROOF TOP SNOW REMOVING APPARATUS, METHOD, AND COMPUTER PROGRAM PRODUCT

(76) Inventor: Fahad Alammari, Bristol, RI (US)

( * ) Notice: Subject to any disclaimer, the term of this patent is extended or adjusted under 35 U.S.C. 154(b) by 678 days.

(21) Appl. No.: 13/539,556

(22) Filed: Jul. 2, 2012

(65) Prior Publication Data

US 2014/0000132 A1 Jan. 2, 2014

(51) Int. Cl.
*E04D 13/10* (2006.01)

(52) U.S. Cl.
CPC ..... *E04D 13/106* (2013.01); *E04D 13/10* (2013.01)

(58) Field of Classification Search
CPC ..... E01H 5/00; E01H 5/06; E01H 5/065; E01H 5/066; E01H 5/061; E04D 13/10; E04D 13/103; E04D 13/106
USPC ..... 37/197, 264, 266, 267, 272, 277, 282, 37/283
See application file for complete search history.

(56) References Cited

U.S. PATENT DOCUMENTS

| | | | | | |
|---|---|---|---|---|---|
| 1,298,200 | A | * | 3/1919 | Görgey | 37/230 |
| 1,526,903 | A | * | 2/1925 | Connolly | 37/197 |
| 2,599,098 | A | * | 6/1952 | Flynn | 126/343.5 R |
| 2,699,614 | A | * | 1/1955 | Welch | 37/229 |
| 3,091,790 | A | * | 6/1963 | Schroeder | 15/105 |
| 3,218,738 | A | * | 11/1965 | Bowerman | 37/268 |
| 3,998,486 | A | * | 12/1976 | Mittelstadt | 37/285 |
| 4,024,654 | A | * | 5/1977 | Snyder | 37/268 |
| 4,034,489 | A | * | 7/1977 | Hughes, Jr. | 37/230 |
| 4,089,127 | A | * | 5/1978 | Maijala | 37/268 |
| 4,249,767 | A | * | 2/1981 | Andreasen | 294/54.5 |
| 5,083,388 | A | * | 1/1992 | Cooley | 37/268 |
| 5,570,524 | A | * | 11/1996 | Groat | 37/285 |
| 5,746,027 | A | * | 5/1998 | Bonerb | 52/1 |
| 5,943,796 | A | * | 8/1999 | Hedstrom | 37/285 |
| 6,003,916 | A | * | 12/1999 | Chalmers | 294/54.5 |
| 6,202,329 | B1 | * | 3/2001 | Supplee et al. | 37/285 |
| 6,442,876 | B1 | * | 9/2002 | Morse | 37/196 |
| 2007/0205308 | A1 | * | 9/2007 | Nishida | 239/547 |
| 2012/0017949 | A1 | * | 1/2012 | Fehringer | 134/34 |
| 2014/0283417 | A1 | * | 9/2014 | Annen | 37/197 |

FOREIGN PATENT DOCUMENTS

| | | | | |
|---|---|---|---|---|
| CA | 2327438 | A1 | * | 6/2002 |
| DE | 102005013696 | B3 | * | 4/2006 |
| DE | 102006006828 | A1 | * | 8/2007 |
| DE | 102006027886 | B3 | * | 9/2007 |
| EP | 2385322 | A2 | * | 11/2011 |
| WO | WO 2012083948 | A1 | * | 6/2012 |
| WO | WO 2012099491 | A1 | * | 7/2012 |

* cited by examiner

*Primary Examiner* — Thomas B Will
*Assistant Examiner* — Joan D Misa
(74) *Attorney, Agent, or Firm* — Oblon, McClelland, Maier & Neustadt, L.L.P.

(57) ABSTRACT

A roof top snow removing apparatus includes a plowing unit configure to plow snow disposed upon a roof top, a motor unit coupled to and providing a motive force for the plowing unit, a track system to guide the motor unit about the roof top, and a controller to control the motor unit based on received input from a user.

1 Claim, 12 Drawing Sheets

ROOF TOP SNOW REMOVING APPARATUS, METHOD, AND COMPUTER PROGRAM PRODUCT

GRANT OF NON-EXCLUSIVE RIGHT

This application was prepared with financial support from the Saudi Arabian Cultural Mission, and in consideration therefore the present inventor(s) has granted The Kingdom of Saudi Arabia a non-exclusive right to practice the present invention.

BACKGROUND

1. Field of the Disclosure

Embodiments described herein relate generally to a roof top snow removing apparatus, method, and computer program product. More particularly, the embodiments described herein relate generally to a plowing unit, a motor unit, and a track system for pushing snow disposed on a roof top to an area below the roof top along with a controller unit for controlling the roof top snow removing apparatus.

2. Description of the Related Art

The "background" description provided herein is for the purpose of generally presenting the context of the disclosure. Work of the presently named inventor, to the extent it is described in this background section, as well as aspects of the description which may not otherwise qualify as prior art at the time of filing, are neither expressly or impliedly admitted as prior art against the present invention.

During winter months in many locations, significant snow accumulation on a roof top can occur over time. While small amounts of snow typically do not present any danger or threat to the roof top, the accumulation of snow over time can produce a significant mass and generate a large downward force upon the roof top as well as the underlying structural support of the roof top. Over an extended period of time, accumulated snow can have severe and even catastrophic repercussions to a roof top structure, leading to structural damage and even a collapse of the entire structure.

Currently, the main method of removing snow from a roof top is by an individual manually removing the snow with a hand held tool, such as a rake. This is typically done from the ground using the hand held tool with an extension apparatus or directly from the roof. Both of these scenarios create very dangerous situations. From the ground, snow can fall on the individual, injuring or crushing them. From the roof, the individual may slip and fall from the roof top and become seriously injured.

Further, if the snow is not consistently removed from the roof top, significant amounts of snow may accumulate over time and overwhelm the current methods of snow removal, leading to inefficient or impossible snow removal. Constantly removing snow from a roof top, especially in blizzard conditions, can be burdensome and dangerous due to constant exposure to severe elements.

SUMMARY

In view of the above noted deficiencies of conventional snow removal techniques, the inventor recognized the benefit of providing a roof top snow removing apparatus that can be controlled, automatically or under user-supervision, from a safe location and safely removes snow from the roof top.

The inventor further recognized the benefit of removing snow from a roof top based on a specified amount of time or a specified amount of snow disposed upon the roof top.

The present disclosure is directed to a roof top snow removing apparatus, method, and computer program product.

According to an exemplary embodiment, the roof top snow removing apparatus includes a plowing unit configured to plow snow disposed upon a roof top, a motor unit coupled to and providing a motive force for the plowing unit, a track system to guide the motor unit about the roof top, and a controller to control the motor unit based on received input from a user.

According to a method embodiment, there is also provided a process of generating an initiation signal within the controller based on a received user input, transmitting the initiation signal to the motor unit, and traversing the track system based on the commands present within the initiation signal.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the present advancements and many of the attendant advantages thereof will be readily obtained as the same becomes better understood by reference to the following detailed description when considered in connection with the accompanying drawings. However, the accompanying drawings and the exemplary depictions do not in any way limit the scope of the advancements embraced by the specification. The scope of the advancements embraced by the specification and drawings are defined by the words of the accompanying claims.

DETAILED DESCRIPTION OF THE EMBODIMENTS

Figure 1:
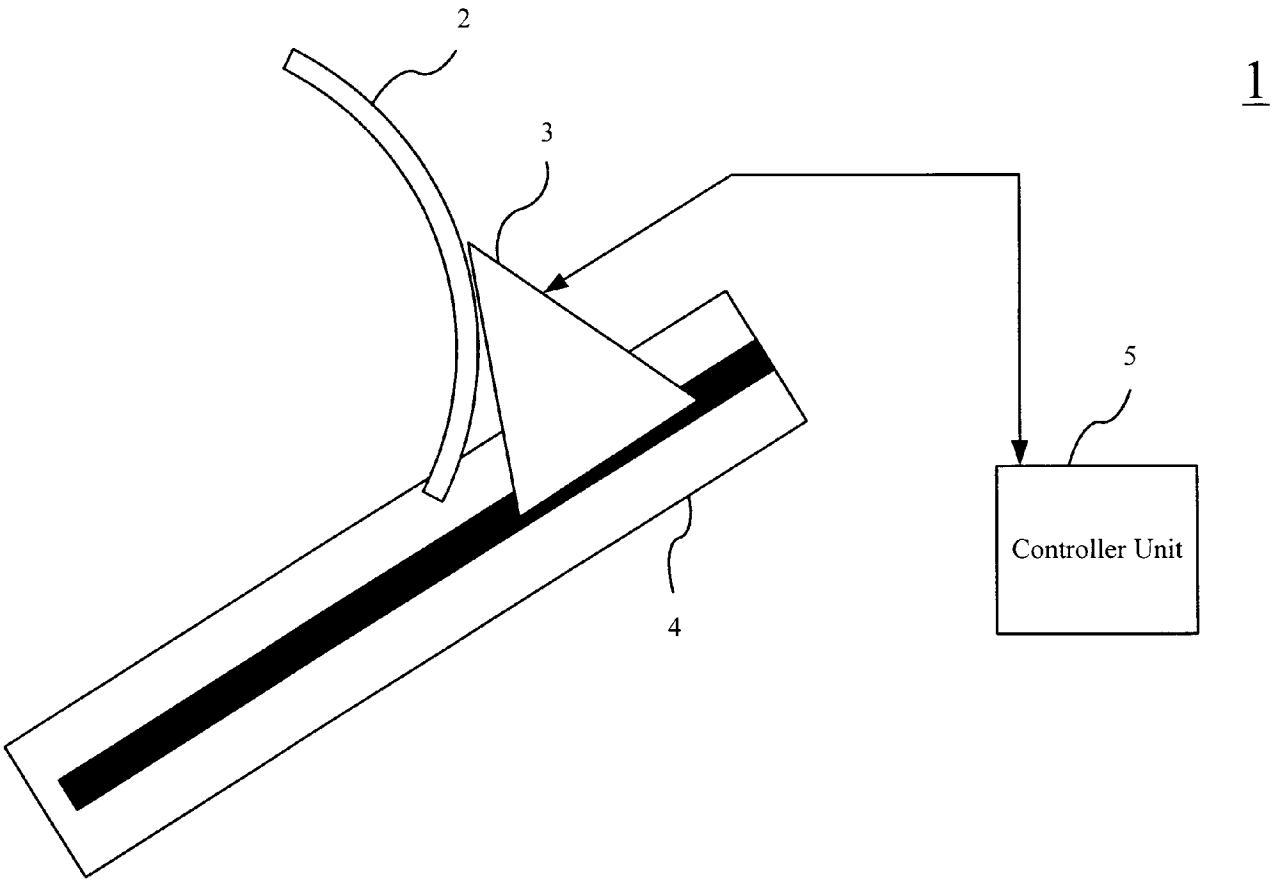
FIG. 1 illustrates an overview of a snow removing apparatus according to an exemplary embodiment.

While this disclosure may suggest many varied embodiments, there is shown in the drawings and will herein be described in detail specific exemplary embodiments, with the understanding that the present disclosure of such embodiments is to be considered as an example of the principles and not intended to limit the invention to the specific embodiments shown and described. In the description below, like reference numerals are used to describe the same, similar, or corresponding parts in the several views of the drawings.

FIG. 1 illustrates an overview of a snow removing apparatus 1 according to an exemplary embodiment and provides a plowing unit 2 configured to plow snow disposed upon a pitched building rooftop, a motor unit 3 coupled to and providing a motive force for the plowing unit, a track system 4 configured to provide a path for the motor unit 3 to traverse the rooftop and force snow, via the plowing unit 2, from the rooftop to an area below the rooftop, and a controller unit 5 configured to receive input from a user, generate an initiation signal based on the received input, and transmit a control signal to the motor unit 3 causing the motor unit 3 to execute a snow plowing cycle.

The plowing unit 2 can be any physical or mechanical structure designed to scoop, capture, or guide snow that has fallen and become disposed upon a rooftop surface. However, a curved shaped blade is used for illustrative purposes.

The motor unit 3 provides a motive force for the plowing unit 2. The motive force can be generated by any appropriate means to include, but not limited by, an electric motor system, a pulley system, a hydraulic system, or an electromagnetic system. Each of these systems can be used in various scenarios based on their availability, the design of the rooftop, and the expected amount of snow to be removed from a rooftop.

The track system 4 can be implemented in any configuration best suited for a particular rooftop. As rooftops come in a wide variety of shapes, sizes, and designs, different configurations of the track system 4 may be required to appropriately guide the motor unit 3 about the rooftop.

The controller unit 5 is configured to generate an initiation signal based on the received input of a user. The initiation signal generated by the controller unit 5 is transmitted to the motor unit 3 which initiates the motor unit 3 to perform an appropriate plowing cycle based on the received input from the user. A plowing cycle can be any predetermined timing cycle programmed by the user into the controller unit 5. In a non-limiting example, the user may wish to program a first set of plowing cycles into the controller 5 when light snowfall is expected. The user may wish to program a second set of plowing cycles if heavier snowfall is expected, such as a blizzard condition. These plowing cycles can be created, modified, or removed at any time by the user via a user interface. The above noted input received by the user, via the user interface, can be made by drop down menu, text input, touch screen selection, voice command, and the such as would be recognized by one of ordinary skill in the art.

The controller unit 5 can also store predefined programs and commands received from a user, via the user interface, in a memory. Stored programs can command the controller unit 5 to generate an initiation signal when certain predetermined conditions have been met such as exceeding a predetermined amount of time since a last cycle or a predetermined amount of snow accumulated upon a rooftop 10. Once a predetermined condition has been met, the controller unit 5 will generate an initiation signal and transmit the initiation signal to the motor unit 3. The initiation signal can command the motor unit 3 to perform a predetermined plowing cycled based on the predetermined condition detected.

Figure 2B:
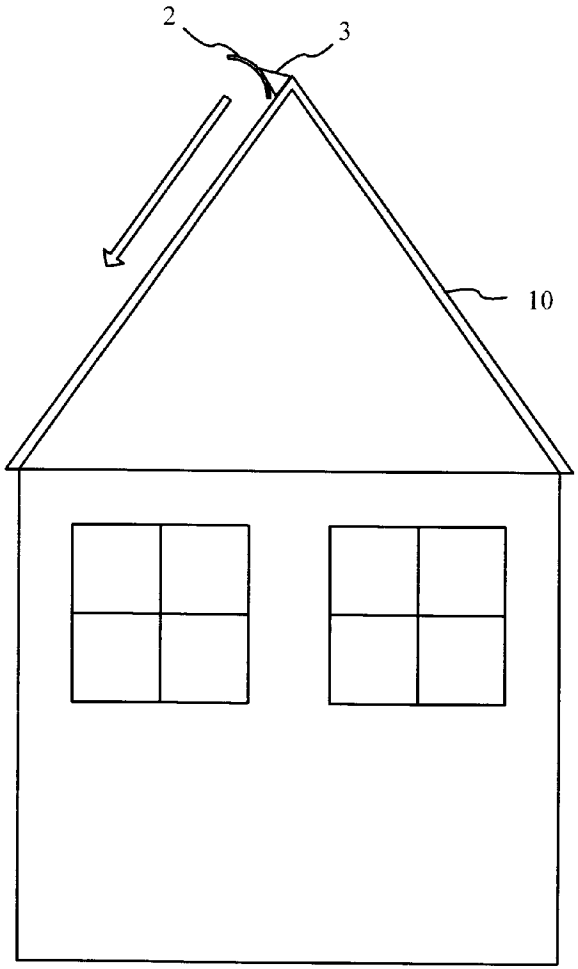
FIGS. 2A and 2B illustrate a front and side view of the roof top snow removing apparatus on a roof top according to an exemplary embodiment.
Figure 2A:
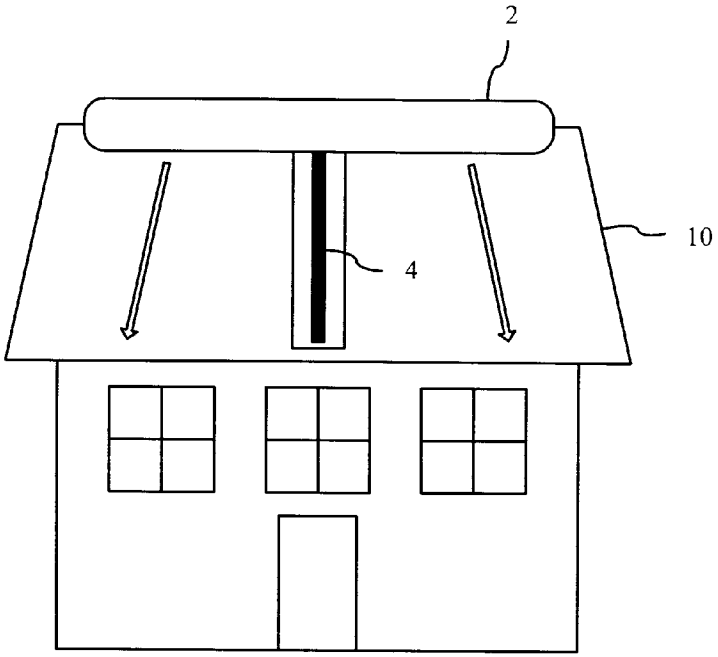

FIGS. 2A and 2B illustrate a front and side view respectively of the roof top snow removing apparatus 1 on a roof top 10 according to an exemplary embodiment. In this embodiment the rooftop 10 is a standard triangle shaped rooftop but can be of any form, structure, material or design. The track system 4 provides a single path in an upward and downward direction for the motor unit 3 and the plowing unit 2. When an initiation signal is transmitted from the controller unit 5, the motor unit 3 traverses the track system 4, guiding the plowing unit 2 from an upper section of the rooftop 10 in a downward direction to a lower section of the rooftop 10. As the plowing unit 2 is guided down the rooftop, the plowing unit 2 captures, holds, and pushes snow disposed upon the rooftop 10 to an area below the rooftop 10. After the motor unit 3 reaches the end of the track system 4, the motor unit 3 traverses the track system 4 in an upward direction until it reached its original position on the upper section of the rooftop 10, thus completing a plowing cycle.

Figure 3:
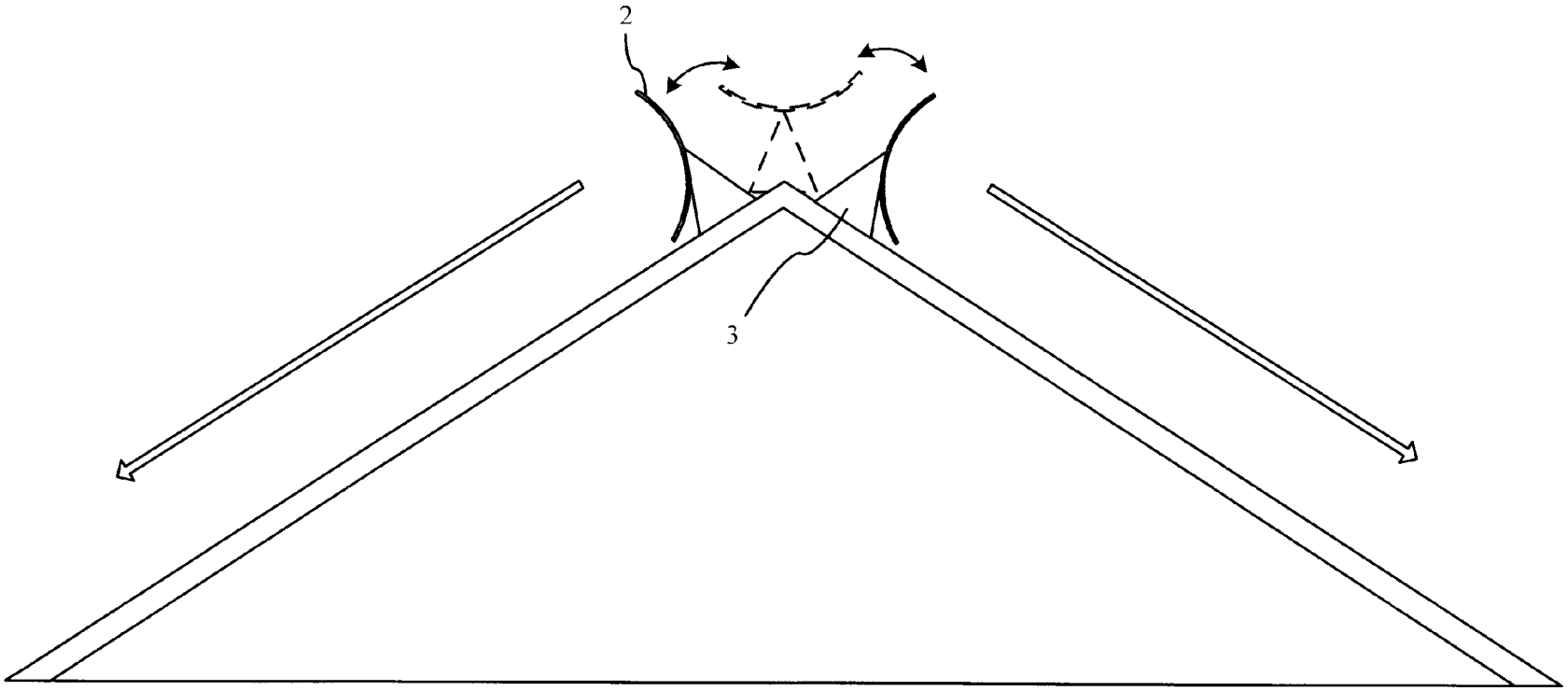
FIG. 3 illustrates a view of the plowing unit pivoting in the vertical direction about the motor unit according to an exemplary embodiment.

In another embodiment, FIG. 3 illustrates the plowing unit 2 pivoting in a vertical direction up and over the motor unit 3. This allows plowing unit 2 to capture, hold, and push snow disposed upon both sides of the rooftop 10 when the track system 4 is configured to allow the motor unit 3 to traverse both sides of a rooftop 10. This embodiment allows the snow removing apparatus to remove snow from two opposite sides of the rooftop 10.

Figure 4:
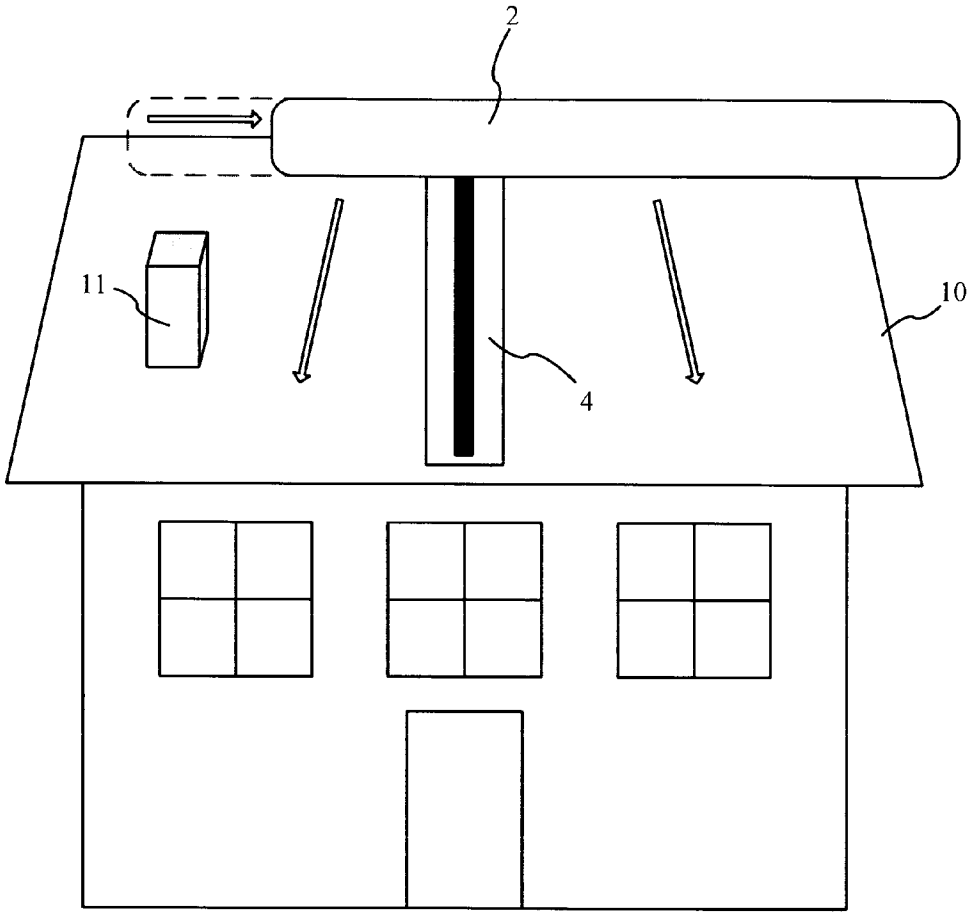
FIG. 4 illustrates a view of the plowing unit shifting in the athwart direction about the motor unit according to an exemplary embodiment.

In another embodiment, FIG. 4 illustrates the plowing unit 2 sliding athwart the motor unit 3 in both the left and the right direction so as to avoid obstacles presented upon the rooftop 10. The rooftop 10 may have various forms of protrusions, such as a chimney 11. In this embodiment as the plowing unit 2 is guided in a downward direction from the rooftop 10 via the motor unit 3, the plowing unit 2 slides athwart the motor unit 3 in order to avoid coming in contact with the chimney 11. When the plowing unit 2 clears the chimney 11, the plowing unit 2 can again slide athwart the motor unit 3 in the opposite direction to its original position.

Figure 5B:
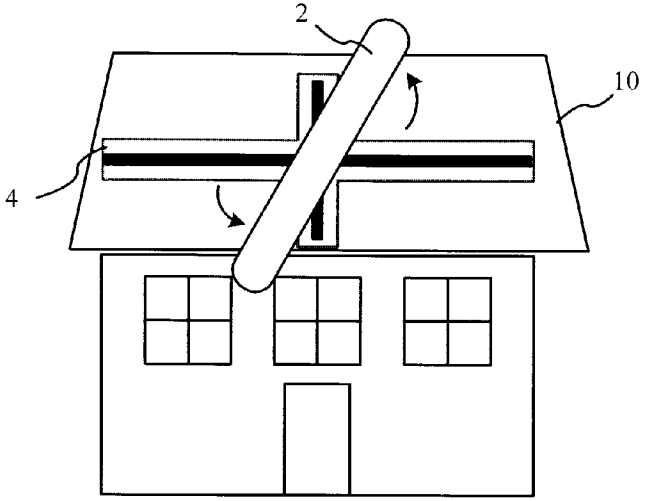
FIGS. 5A, 5B, and 5C illustrate a plowing cycle of the roof top snow removing apparatus according to an exemplary embodiment.
Figure 5C:
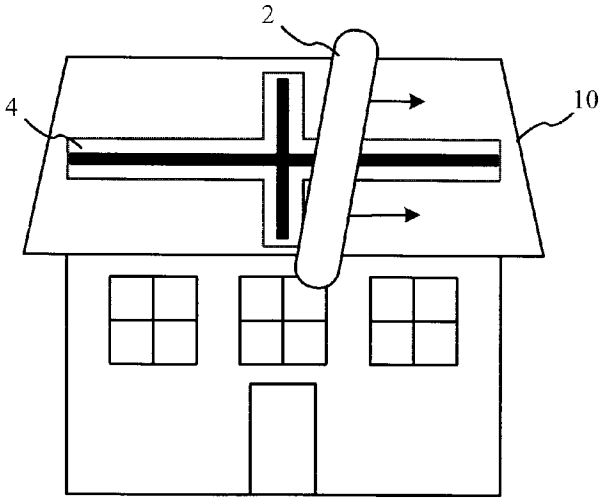
Figure 5A:
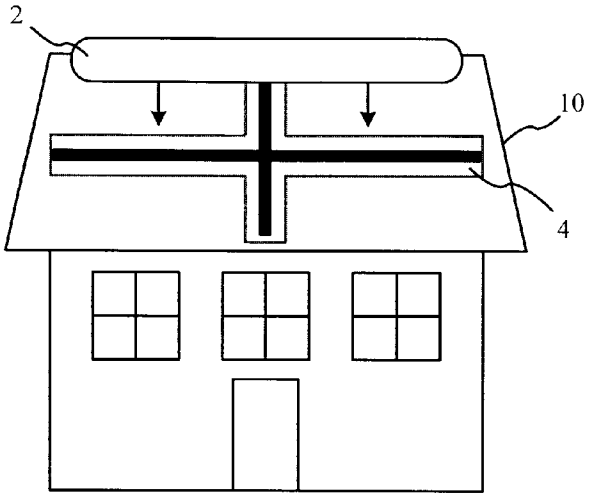

In another embodiment, FIGS. 5A, 5B, and 5C illustrate respectively how the plowing unit 2 can pivot in the horizontal direction about the motor unit 3. In this embodiment, the plowing unit can not only plow snow in a downward direction, but also in both the left and right directions. In a non limiting example, the track system 4 may be configured with both horizontal and vertical sections on the rooftop 10. When the motor unit 3 initiates a plowing cycle, the motor unit 3 guides the plowing unit 2 in a downward direction across the surface of the rooftop 10. When the motor unit 3 reaches the intersection of the vertical and horizontal sections of the track system 4, the plowing unit 2 can pivot about the motor unit 3 approximately 90° and subsequently traverses the rooftop along the horizontal section of the track system 4.

Figure 6:
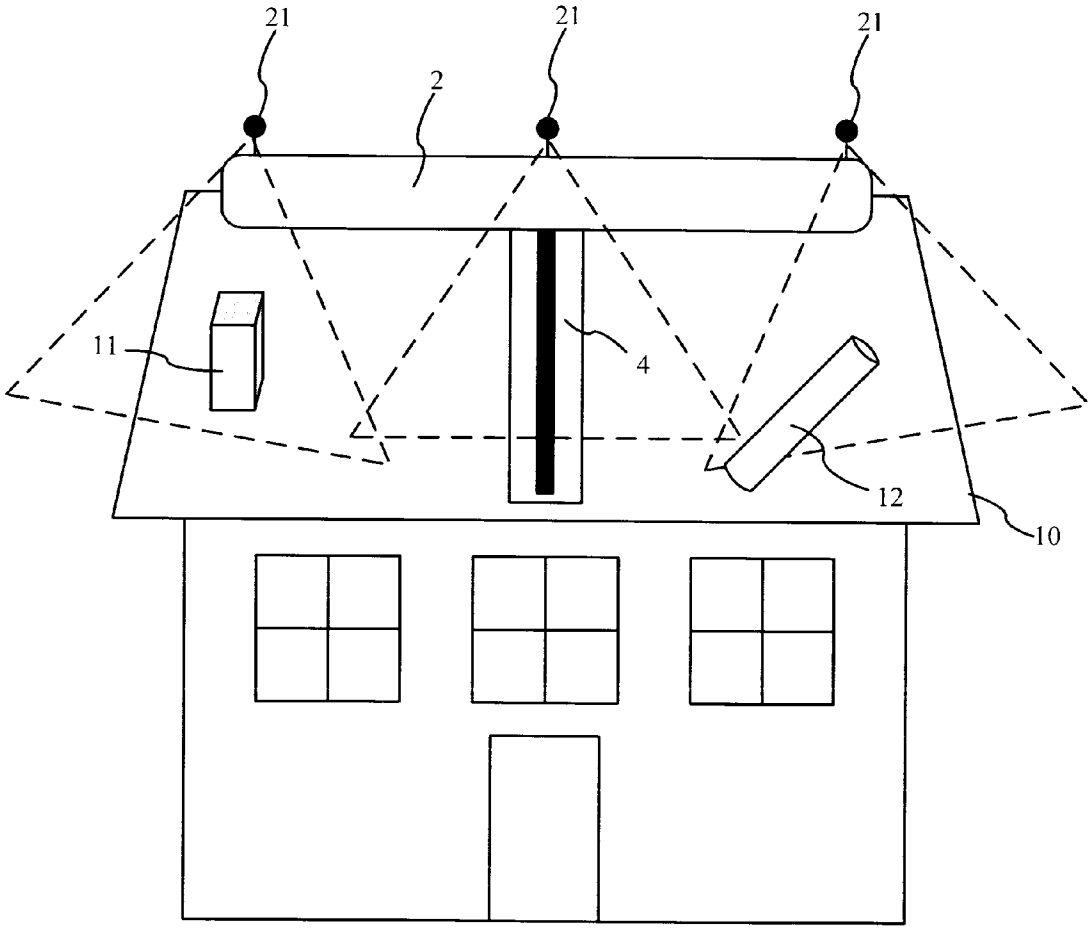
FIG. 6 illustrates a sensor configuration according to an exemplary embodiment.

In another embodiment, FIG. 6 illustrates a sensor apparatus 21, mounted to the plowing unit 2, which detects large objects residing within an amount of snow and triggers the motor unit 3 or the plowing unit 2, via the controller unit 5, to perform a particular set of actions upon detection of a large object within the amount of snow as shown in FIG. 6. In FIG. 6 there is shown not only a chimney 11 but also a large tree branch 12 currently residing upon the rooftop 10. If the plowing unit comes in contact with either the chimney 11 or the large tree branch 12, significant damage may occur to either the rooftop 10 or the plowing unit 2. In this embodiment, when the chimney 11 or the large tree branch 12 is detected by the sensor apparatus 21, the snow removing apparatus 1 can perform any number of predetermined actions such as rotating the plowing unit 2 athwart the motor unit 3 or rotate the plowing unit 2 horizontally about the motor unit 3 in order to avoid contacting the chimney 11 or the large tree branch 12. The sensor apparatus 21 can also detect the amount of snow currently disposed upon the rooftop and initiate a trigger signal to the controller 4 to generate and transmit a plowing cycle based on the amount of snow currently disposed upon the rooftop 10.

Figure 7:
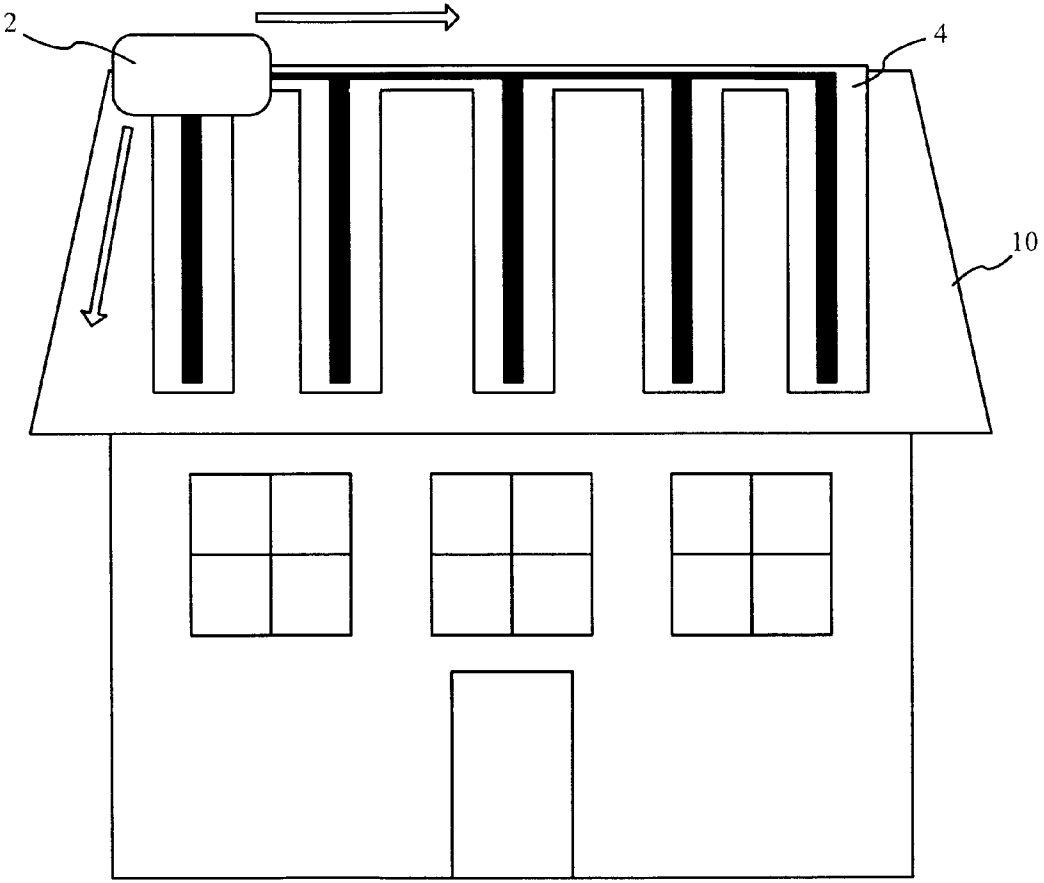
FIG. 7 illustrates is a track system with multiple paths according to an exemplary embodiment.

FIG. 7 presents another non-limiting example of a track system 4 configuration for the motor unit 3 and plowing unit 2. In this example the plowing unit 2 may be of a smaller and more discrete size. The tracking system may be arranged such that there are a plurality of vertical track section connected to a single horizontal track section. The plowing unit 2 traverses the rooftop 10, via the motor unit 3, over the plural vertical sections of the track system 4 via the main horizontal section. This presents yet another configuration of the track system 4.

Figure 8B:
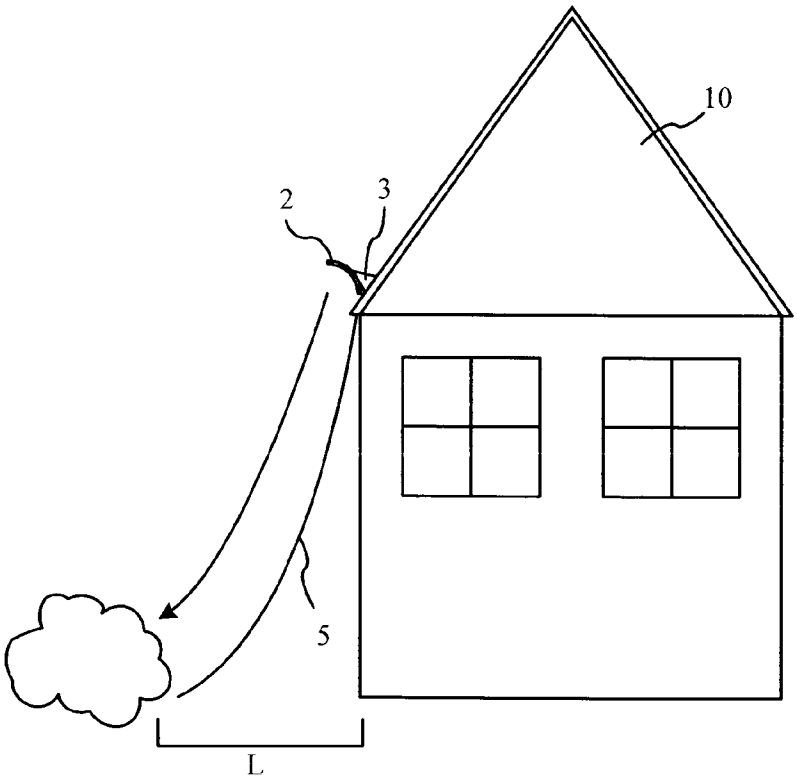
FIGS. 8A and 8B illustrate a shield apparatus according to an exemplary embodiment.
Figure 8A:
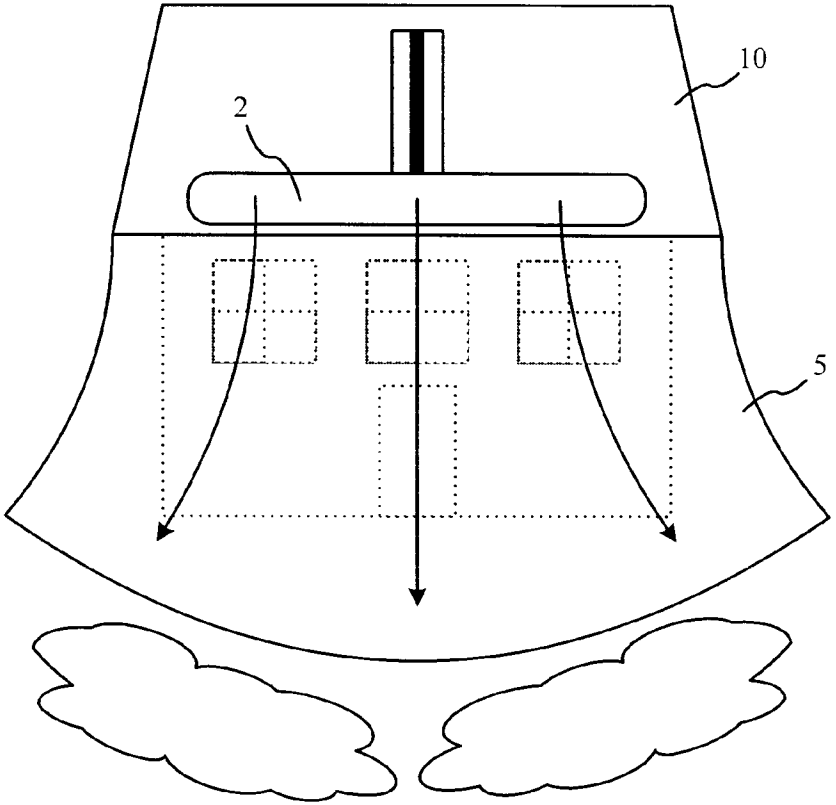

In another embodiment, the snow removing apparatus 1 can also include a shield apparatus for guiding snow forced from the rooftop 10, by the plowing unit 2, to a designated area below the rooftop 10 as illustrated in FIGS. 8A and 8B respectively. The designated area below the rooftop 10 can be any predetermined distance away from a building on which the rooftop is attached. In many cases it is harmful for both the house and the foundation on which the house resides to have snow accumulated immediately below the roof top 10. Snow at the very foot of building structure can damage the foundation of the structure and cause flooding into lower sections of the structure, such as a basement. The shield apparatus 5 can extend from the bottom section of the rooftop 10 to an area sufficiently away from the house to avoid these dangers. The shield apparatus 5 may be deployed manually via a manual actuator or electronically via the controller unit 5. The shield apparatus can also be constructed using any flexible or rigid material.

Figure 9:
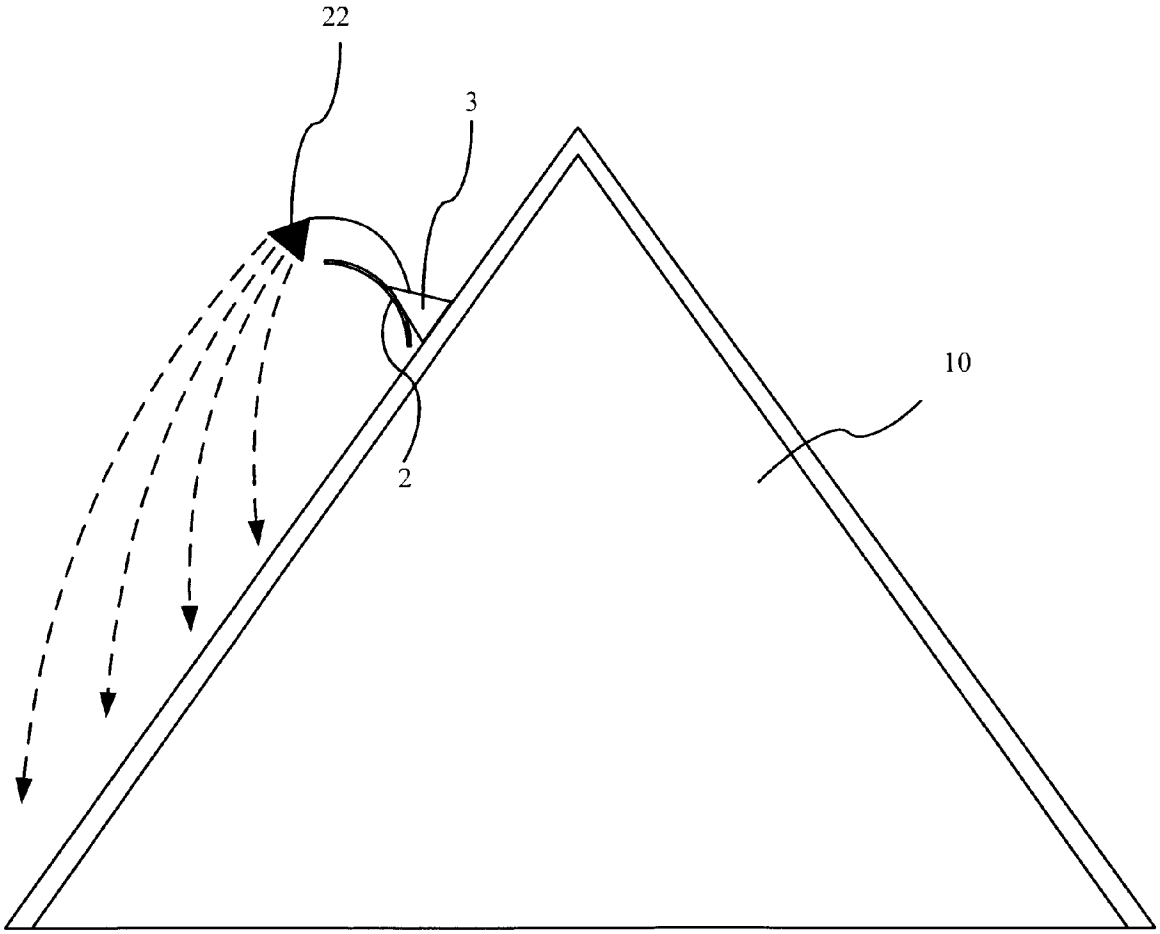
FIG. 9 illustrates sprinkler units affixed upon the plowing unit according to an exemplary embodiment.

In another embodiment the plowing unit 2 also includes one or more sprinkler units 22 affixed upon the plowing unit 2 or the motor unit 3 for spraying liquid into the amount of snow currently disposed upon the roof 10 as illustrated in FIG. 9. The liquid sprayed from the spraying unit can be any form of liquid that facilitates snow removal from the rooftop 10 and may include water heated to a predetermined temperature or a brine solution. The sprinkler units 22 can be activated manually via a manual actuator or electronically via the controller unit 5.

Figure 10:
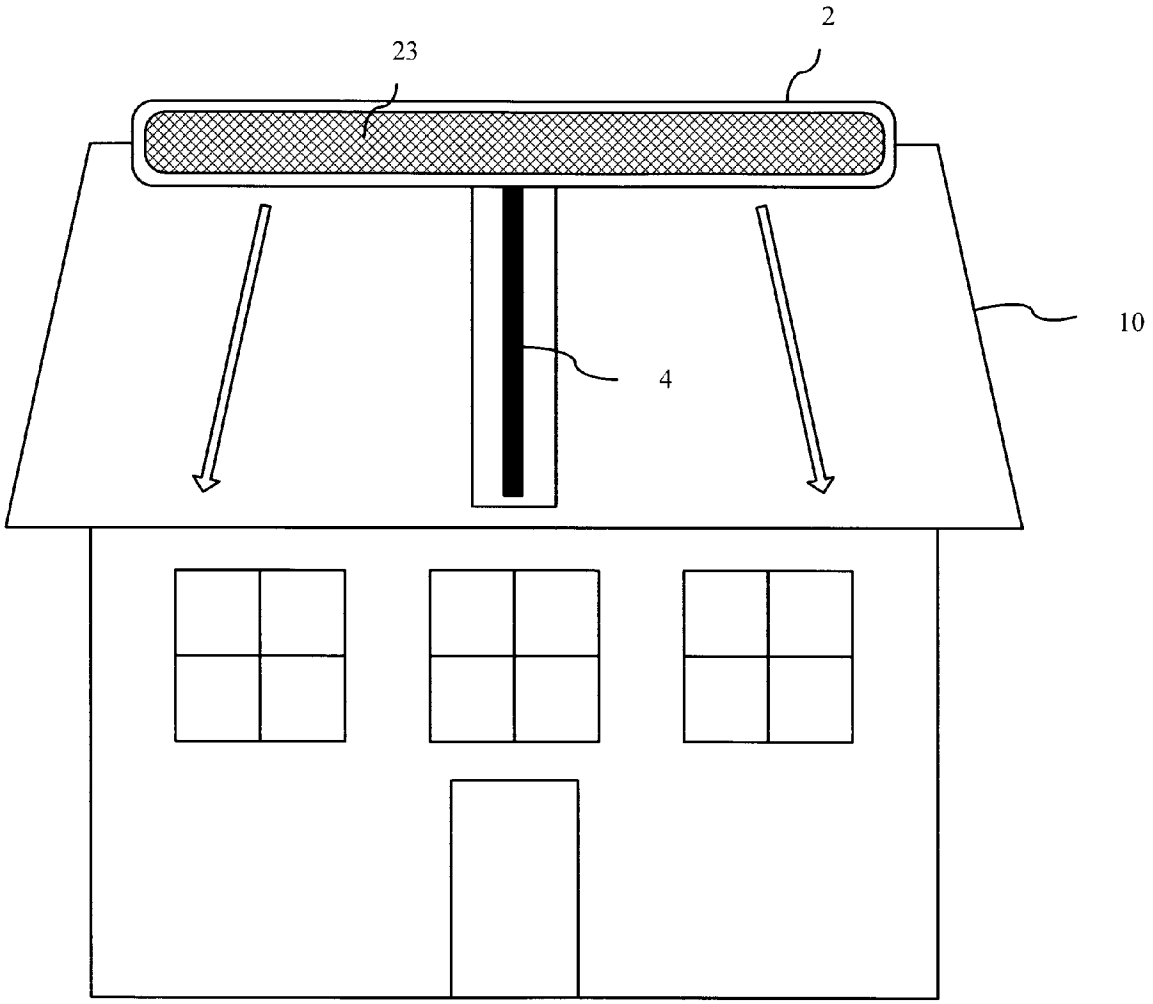
FIG. 10 illustrates a heating unit for the plowing unit according to an exemplary embodiment.

In another embodiment the plowing unit 2 can also include a heating unit 23 to heat the snow disposed upon the rooftop 10 as the plowing unit 2 is guided about the rooftop 10 as illustrated by FIG. 10. The heating unit 23 can be activated manually via a manual actuator or electronically via the controller unit 5.

Figure 11:
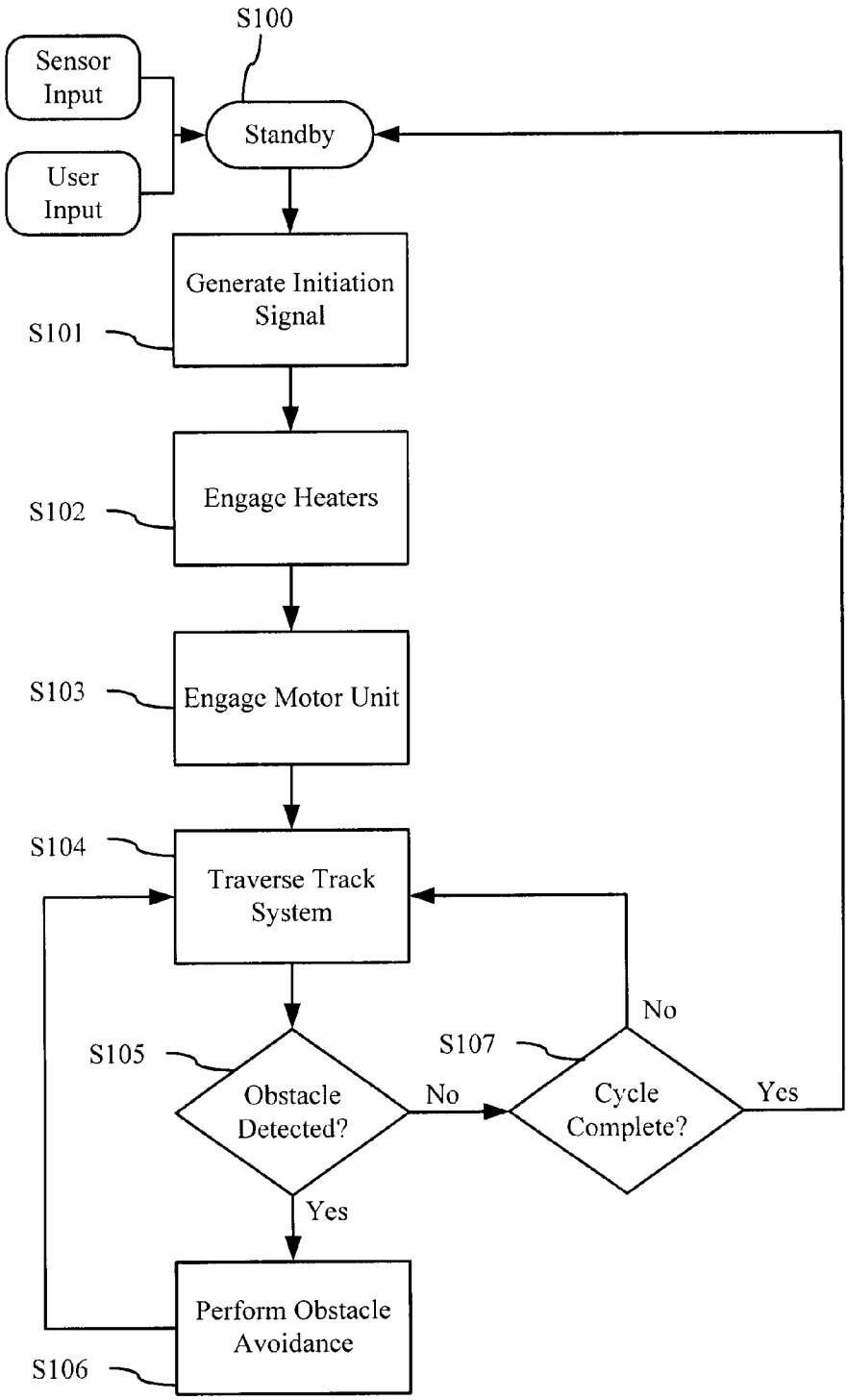
FIG. 11 is flow diagram of a roof top snow removing apparatus according to an exemplary embodiment.

In the exemplary method of a snow removing apparatus is presented in FIG. 11. Initially the snow removing apparatus 1 is standing by at step S100 to receive an input from either a sensor or a user. Once an input is received from either the sensor or the user, the controller 5 generates an initiation signal based on the received input as step S101. Once the initiation signal is received at the motor unit 3, the heaters on the plowing unit 2 are engaged as step S102, heating the plowing unit 2 up to a predetermined temperature. Once the plowing unit 2 has reached a predetermined temperature sufficient to melt the snow disposed upon the rooftop 10, the motor unit 3 is engaged as step S103 and subsequently traverses the track system in a predetermined cycle as step S104. While the motor unit is traversing the rooftop 10 based on the predetermined plowing cycle, if an obstacle is detected via the sensor apparatus 21 at step S105 the plowing unit and/or the motor unit 3 will perform an obstacle avoidance maneuver as step S106. The obstacle avoidance maneuver can include moving the plowing unit 2 in a vertical or horizontal direction about the motor unit 3 or moving the plowing unit 2 in the athwart direction. Once the obstacle has been successfully avoided, the motor unit 3 and plowing unit 2 will continue to traverse the track system 4 until another obstacle is detected. If no further obstacles are detected as step S105, the controller unit 5 will determine if the predetermined plowing cycle has been completed at step S107. If the predetermined plowing cycle is determined to have been completed, the motor unit 3 and the plowing unit 2 will return to the initial position aboard the track system 4 and standby at step S100.

Figure 12:
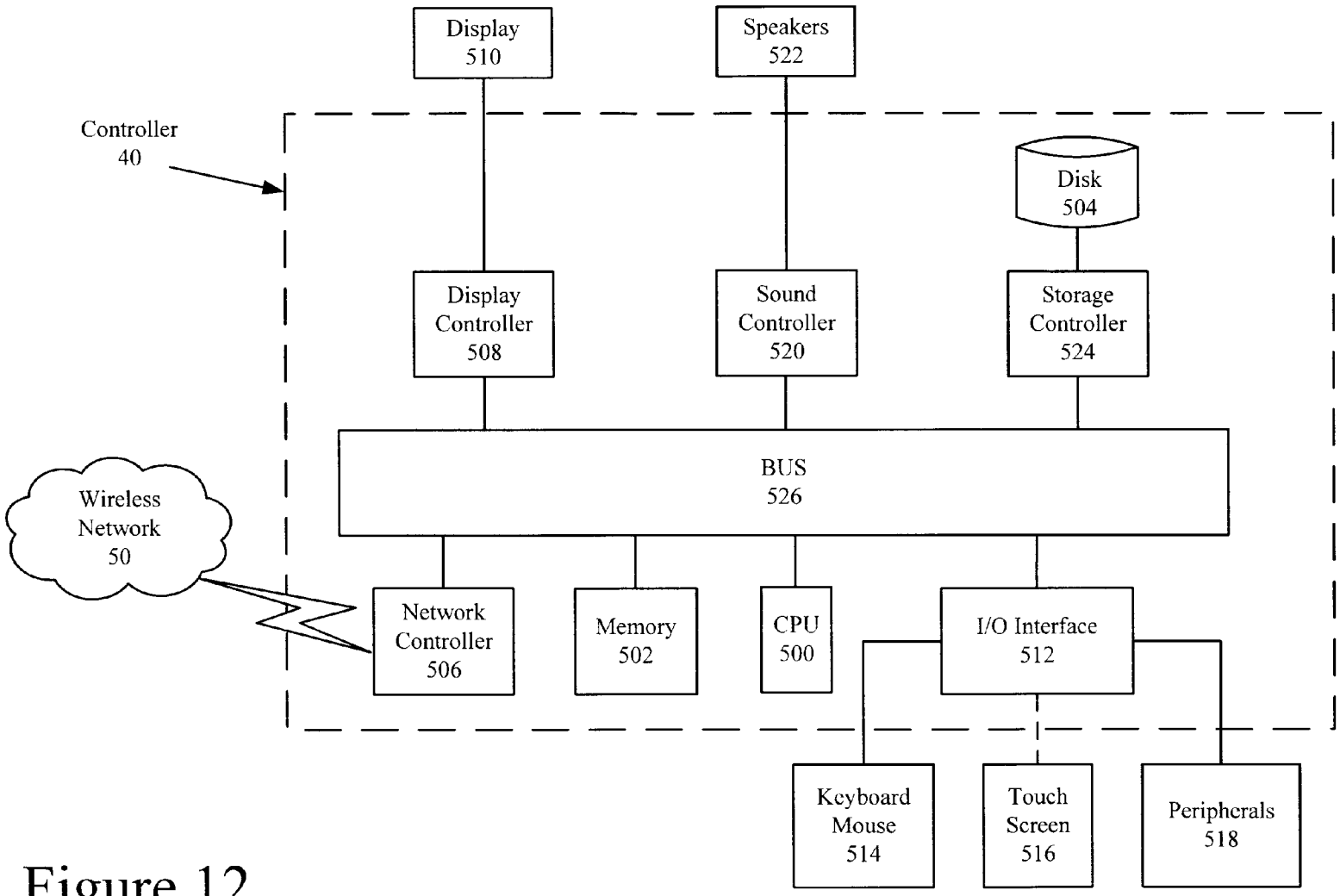
FIG. 12 is a hardware block diagram of an exemplary roof top snow removing apparatus according to an exemplary embodiment.

Next, a hardware description of the snow removing apparatus 1 according to exemplary embodiments is described with reference to FIG. 12. In FIG. 12, the snow removing apparatus 1 includes a CPU 500 which performs the processes described above. The process data and instructions may be stored in memory 502. These processes and instructions may also be stored on a storage medium disk 504 such as a hard drive (HDD) or portable storage medium or may be stored remotely. Further, the claimed advancements are not limited by the form of the computer-readable media on which the instructions of the inventive process are stored. For example, the instructions may be stored on CDs, DVDs, in FLASH memory, RAM, ROM, PROM, EPROM, EEPROM, hard disk or any other information processing device with which the snow removing apparatus 1 communicates, such as a server or computer.

Further, the claimed advancements may be provided as a utility application, background daemon, or component of an operating system, or combination thereof, executing in conjunction with CPU 500 and an operating system such as Microsoft Windows 7, UNIX, Solaris, LINUX, Apple MAC-OS and other systems known to those skilled in the art.

CPU 500 may be a Xenon or Core processor from Intel of America or an Opteron processor from AMD of America, or may be other processor types that would be recognized by one of ordinary skill in the art. Alternatively, the CPU 500 may be implemented on an FPGA, ASIC, PLD or using discrete logic circuits, as one of ordinary skill in the art would recognize. Further, CPU 500 may be implemented as multiple processors cooperatively working in parallel to perform the instructions of the inventive processes described above.

The snow removing apparatus 1 in FIG. 12 also includes a network controller 506, such as an Intel Ethernet PRO network interface card from Intel Corporation of America, for interfacing with network 50. As can be appreciated, the network 50 can be a public network, such as the Internet, or a private network such as an LAN or WAN network, or any combination thereof and can also include PSTN or ISDN sub-networks. The network 50 can also be wired, such as an Ethernet network, or can be wireless such as a cellular network including EDGE, 3G and 4G wireless cellular systems. The wireless network can also be WiFi, Bluetooth, or any other wireless form of communication that is known.

The snow removing apparatus 1 further includes a display controller 508, such as a NVIDIA GeForce GTX or Quadro graphics adaptor from NVIDIA Corporation of America for interfacing with display 510, such as a Hewlett Packard HPL2445w LCD monitor. A general purpose I/O interface 512 interfaces with a keyboard and/or mouse 514 as well as a touch screen panel 516 on or separate from display 510. General purpose I/O interface also connects to a variety of peripherals 518 including printers and scanners, such as an OfficeJet or DeskJet from Hewlett Packard.

A sound controller 520 is also provided in the snow removing apparatus 1, such as Sound Blaster X-Fi Titanium from Creative, to interface with speakers/microphone 522 thereby providing sounds and/or music. The speakers/microphone 522 can also be used to accept dictated words as commands for controlling the snow removing apparatus 1 or for providing location and/or property information with respect to the target property.

The general purpose storage controller 524 connects the storage medium disk 504 with communication bus 526, which may be an ISA, EISA, VESA, PCI, or similar, for interconnecting all of the components of the snow removing apparatus 1. A description of the general features and functionality of the display 510, keyboard and/or mouse 514, as well as the display controller 508, storage controller 524, network controller 506, sound controller 520, and general purpose I/O interface 512 is omitted herein for brevity as these features are known.

The invention claimed is:

1. A snow removing apparatus comprising:

a plowing unit configured to plow snow disposed upon a pitched roof top, the plowing unit having a curved blade with a concave portion configured to push snow off the pitched roof top;

a motor unit having a triangular-shaped cross-section coupled to and providing a motive force for the plowing unit, the plowing unit pivots about the motor unit when the motor unit drives the plowing unit across an apex of the pitched roof top such that the concave portion of the curved blade is oriented toward a lower edge of a first side of the pitched roof top and oriented to a lower edge of the other side of the pitched roof when the motor unit drives the plowing unit to the other side of the pitched roof;

a track system configured to provide a path for the motor unit to traverse the roof top and force snow, via the plowing unit, from the roof top to an area below the roof top, the track system including on the first side of the pitched roof top a horizontal path that is parallel with the lower edge of the first side of the pitched roof top, and a vertical path that is substantially orthogonal to the horizontal path and extends in a downward direction from the apex to the lower edge of the first side of the pitched roof top to the lower edge of the other side of the pitched roof, the motor unit configured to rotate the plowing unit so the concave portion is oriented to push snow in a horizontal direction off a side of the first side of the pitched roof top;

a controller configured to receive input from a user and execute a snow plowing cycle by sending control signals to the motor unit based on the received input;

a shield apparatus that is attached to the lower edge of the first side of the pitched roof top, and having a length that extends along an entire length of the lower edge of the first side of the pitched roof, the shield apparatus being deployed from a retracted position to an extended position, and when in the extended position having a bottom edge that rests on ground a predetermined distance away from a foundation of a house on with the pitched roof top is disposed so that snow forced from the pitched roof top via the plowing unit slides down the shield apparatus to at least the predetermined distance away from the lower edge of the rooftop and when the snow melts, resulting water does not flood a basement of the house, the shield apparatus being fully retractable based on commands received by the controller;

a sensor that detects an amount of snow disposed upon the pitched roof top and triggers the controller to execute a first predetermined action upon the detection of a predetermined amount of snow, the sensor also detects a large object on the pitched rooftop and triggers the motor unit to performed a second predetermined action upon detection of a large object;

a heating device configured to heat the concave portion of the plowing unit to a predetermined temperature; and a sprinkler unit affixed to the plowing unit that spays a liquid onto the amount of snow disposed upon the pitched roof top, wherein the liquid sprayed by the sprinkler unit is heated by the heating device prior to being sprayed from the sprinkler unit.

* * * * *